US008225698B2

(12) United States Patent
Yang

(10) Patent No.: US 8,225,698 B2
(45) Date of Patent: Jul. 24, 2012

(54) SUN GEAR-DRIVEN MAGNIFICATION DRIVING TOOL

(76) Inventor: Tai-Her Yang, Dzan-Hwa (TW)

( * ) Notice: Subject to any disclaimer, the term of this patent is extended or adjusted under 35 U.S.C. 154(b) by 318 days.

(21) Appl. No.: 12/461,524

(22) Filed: Aug. 14, 2009

(65) Prior Publication Data

US 2011/0036206 A1 Feb. 17, 2011

(51) Int. Cl.
*B25B 17/02* (2006.01)
*B25B 13/48* (2006.01)

(52) U.S. Cl. ..... 81/56; 81/55

(58) Field of Classification Search ..... 81/56, 57, 81/55

See application file for complete search history.

(56) References Cited

U.S. PATENT DOCUMENTS 1,343,667 A * 6/1920 Evensen ..... 81/56
2,537,382 A * 1/1951 Valentin ..... 81/56
2,955,496 A * 10/1960 La Torre ..... 81/56
3,472,083 A * 10/1969 Schnepel ..... 475/317
3,916,734 A * 11/1975 Sawan ..... 81/56
3,942,398 A * 3/1976 Fletcher et al. ..... 81/56
3,979,965 A * 9/1976 Vuceta ..... 74/410
4,403,529 A * 9/1983 Ikeda et al. ..... 81/56
5,123,308 A * 6/1992 Shaffer ..... 81/57.31
5,238,461 A * 8/1993 Gotman ..... 475/248
5,354,246 A * 10/1994 Gotman ..... 475/248
5,582,079 A * 12/1996 Matsumura et al. ..... 81/56
5,953,965 A * 9/1999 Kaneyama et al. ..... 81/55
5,964,128 A * 10/1999 Kaneyama et al. ..... 81/56
6,058,810 A * 5/2000 Junkers ..... 81/56
6,487,940 B2 * 12/2002 Hart et al. ..... 81/57.14
7,225,707 B2 * 6/2007 Knopp ..... 81/57
7,794,355 B2 * 9/2010 Pusateri ..... 475/331
7,987,745 B2 * 8/2011 Gauthier et al. ..... 81/57.31
2010/0018366 A1 * 1/2010 Hu ..... 81/436
2010/0180731 A1 * 7/2010 Gauthier et al. ..... 81/57

* cited by examiner

*Primary Examiner* — David B Thomas
(74) *Attorney, Agent, or Firm* — Bacon & Thomas, PLLC

(57) ABSTRACT

The present invention of a sun gear-driven magnification driving tool relies on randomly attachable and removable sun gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

17 Claims, 7 Drawing Sheets

SUN GEAR-DRIVEN MAGNIFICATION DRIVING TOOL

BACKGROUND OF THE INVENTION (a) Field of the Invention

The sun gear-driven screw and nut set installs the outer ring gear on the nut, and installs the planetary gear on the bolt. The screw and nut set must be installed in the planetary gear set structure one by one which entails a relatively high production cost. The present invention of a sun gear-driven magnification driving tool relies on randomly attachable and removable sun gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

(b) Description of the Prior Art

The sun gear-driven screw and nut set installs the outer ring gear on the nut, and installs the planetary gear on the bolt. The screw and nut set must be installed in the planetary gear set structure one by one. Each screw and nut set must all be installed on the gear set which entails a relatively high production cost.

SUMMARY OF THE INVENTION

The present invention of a sun gear-driven magnification driving tool relies on randomly attachable and removable sun gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

Figure 1:
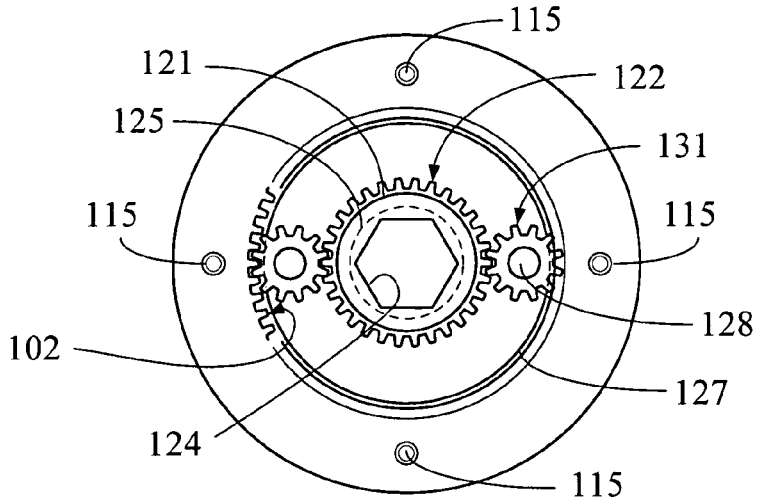
FIG. 1 is a top cross-sectional view of the present invention

DESCRIPTION OF MAIN COMPONENT SYMBOLS (100): Cover
(101): Nut
(102): Inner ring gear
(103): Sleeve
(111): Nut-driven ring body
(115): Fixed screw
(112): Inner thread
(121): Sun gear cylinder
(122): Cylindrical tooth tip
(123): Polyhedral prismatic structure
(123'): Sleeve with inner polygonal hole
(124): Inner polygonal hole
(124'): Polyhedral cylinder
(125): Boss
(125'): Axial hole
(126): Axial hole
(126'): Boss
(127): Planetary gear radial arm base
(128): Jack post
(131): Planetary gear
(140): Stud
(141): Inner polygonal hole
(141'): Polyhedral cylinder
(142): Thread
(200): Structure
(300): Fixed element

DETAILED DESCRIPTION OF THE PREFERRED EMBODIMENTS

The sun gear-driven screw and nut set installs the outer ring gear on the nut, and installs the planetary gear on the bolt. The screw and nut set must be installed in the planetary gear set structure one by one which entails a relatively high production cost. The present invention of a sun gear-driven magnification driving tool relies on randomly attachable and removable sun gear-driven magnification driving tools to lock, adjust, and disassemble applied mechanism with screw structure such as screw locking device, screw adjusting device, and individual screw and nut set that do not need the installation of outer ring gear and planetary gear while reducing the installation cost for over a pair of such mechanisms.

FIG. 1 is the top cross-sectional view of the present invention.

Figure 2:
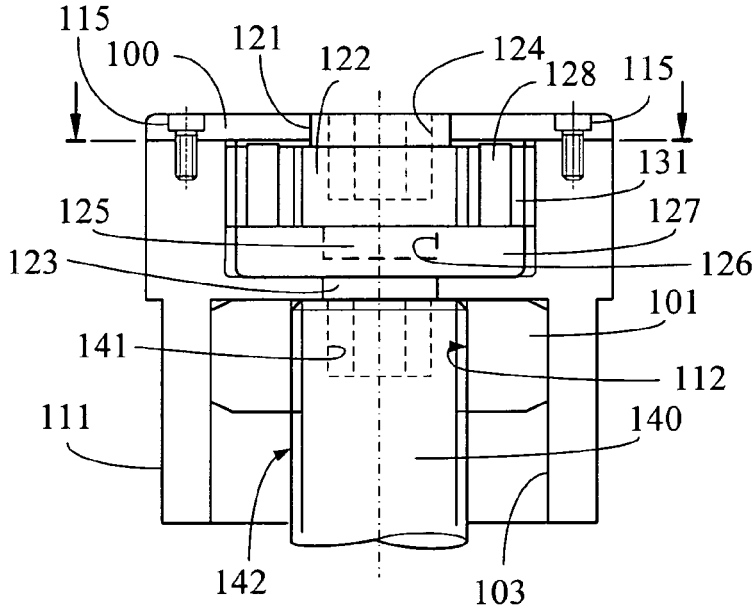
FIG. 2 is a cross sectional view of the present invention

FIG. 2 is a cross-sectional of the present invention.

Figure 3:
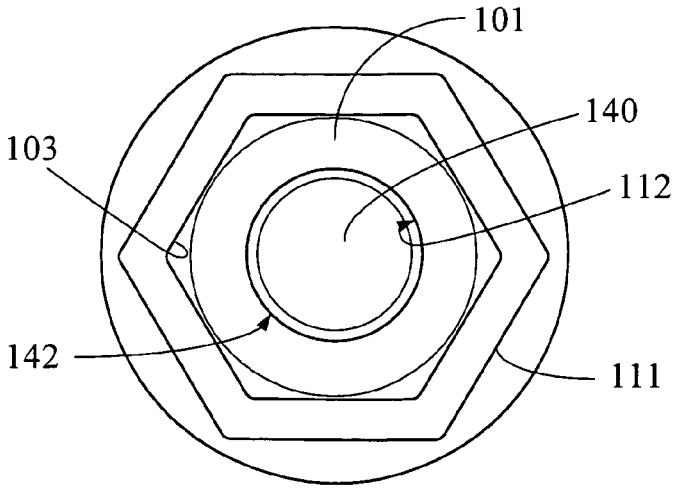
FIG. 3 is a bottom view of the present invention

FIG. 3 is the bottom view of the present invention.

Figure 4:
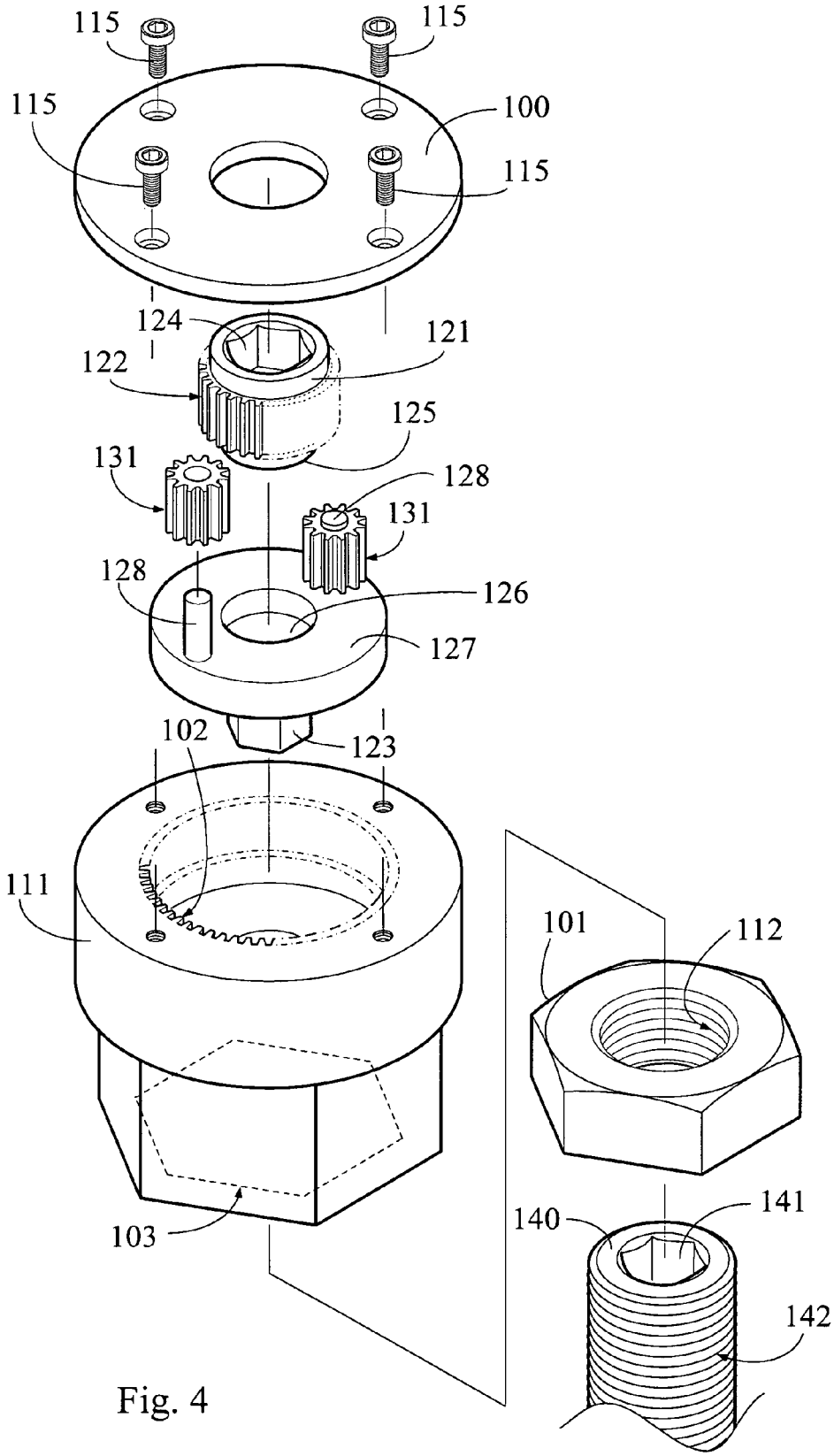
FIG. 4 is a dimensional exploded view of the present invention

FIG. 4 is a dimensional exploded view of the present invention.

Figure 5:
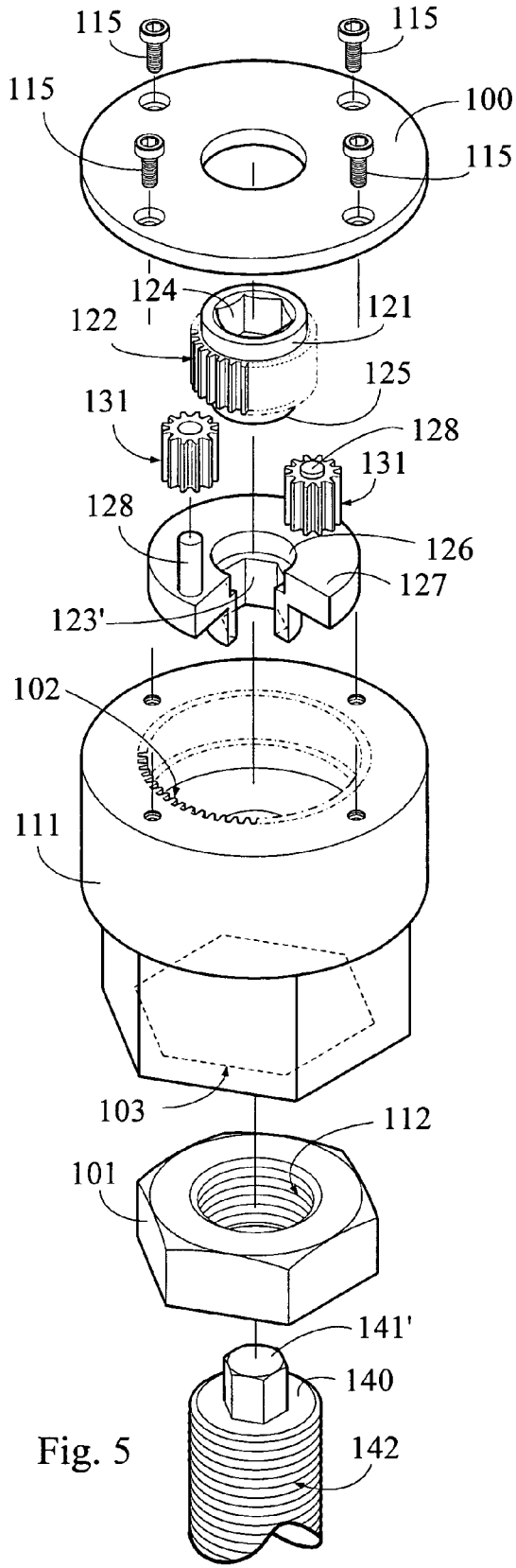
FIG. 5 is a dimensional view of the polyhedral cylinder (141') replacing the inner polygonal hole (141) in FIG. 5 of the present invention
Figure 6:
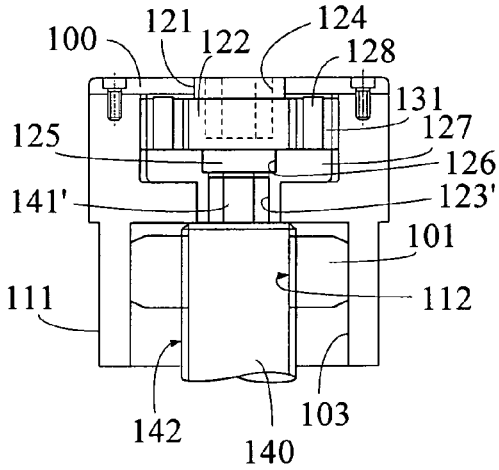
FIG. 6 is a sectional view of the installation of polyhedral cylinder (141') in FIG. 1 to FIG. 4 of the present invention

As shown in FIG. 1 to FIG. 4, the present invention drives the following screw and nut devices including:

Nut (101): A structure with polygonal exterior and inner thread (112) on inner part for fastening on the thread (142) of the stud (140);

Stud (140): Stud (140) includes threads (142) while the stud head of the stud (140) includes concave polygonal hole (141) or it assumes the form of a polyhedral cylinder (141');

The inner polygonal hole (141) of the aforementioned stud head of the stud (140) is optionally replaced by the polyhedral cylinder (141') as shown in the dimensional view in FIG. 5 wherein the polyhedral cylinder (141') replaces the inner polygonal hole (141) in FIG. 1 to FIG. 4. When the polyhedral cylinder (141') is chosen to be installed, the polyhedral prismatic structure (123) coupled with the polyhedral cylinder (141') will be transformed into a sleeve with inner polygonal hole (123') in order to fit into and drive the polyhedral cylinder (141'). FIG. 6 is a cross-sectional view of the installation of the polyhedral cylinder (141') in FIG. 1 to FIG. 5.

Figure 7:
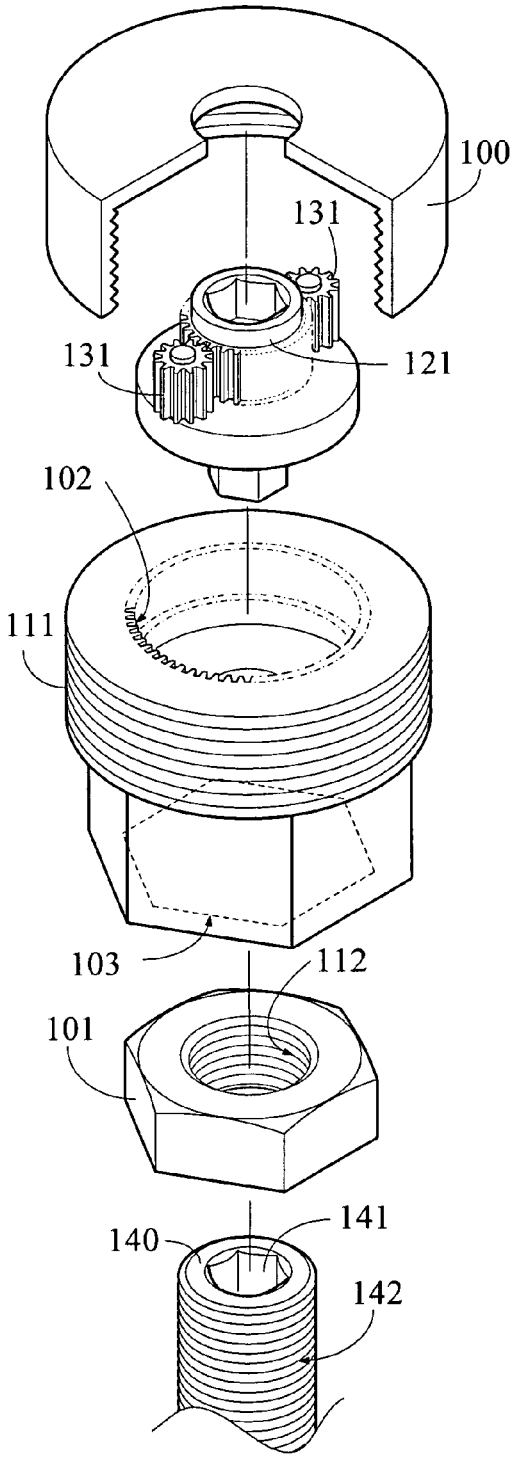
FIG. 7 is an operational dimensional view of the screw-on type guard of the present invention
Figure 8:
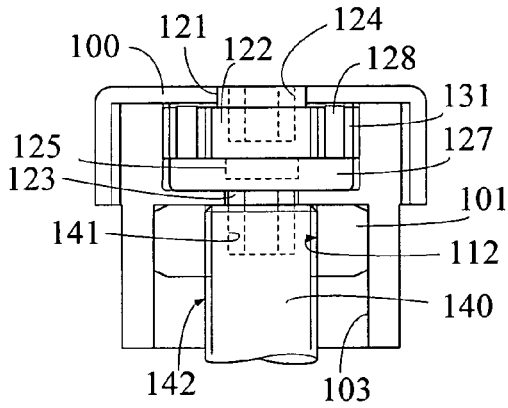
FIG. 8 is the cross-sectional view of FIG. 7

FIG. 7 is the operational dimensional view of the screw-on type guard of the present invention FIG. 8 is the cross-sectional view of FIG. 7

The main components of the sun gear-driven magnification driving tool includes:

Cover (100): A removable cap-shape locking structure to provide fixed screw (115) a means of axial lockability or by using a bottle cap-shape cover as an outer ring to screw or fasten itself on the top section of the nut-driven ring body (111). The planetary gear set is protected by means of the aforementioned cover (100). The cover (100) has a hole in the middle for inserting a tool to drive the sun gear cylinder (121) or to provide an exposed opening at the upper axial section for tools to drive the sun gear cylinder (121).

Nut-driven ring body (111): A ring shape structure with its upper inner ring integrated as a whole or be installed with an inner ring gear (102) in an assembly manner. The lower section of the ring-shape structure includes a sleeve (103) to couple with the exterior side of the nut (101) so that when the inner ring gear (102) is driven, nut (101) is loosen or locked by its rotating or counter-rotating motion.

Planetary gear (131): To provide coupling between the sun gear of the sun gear cylinder (121) and the inner ring gear (102) of the installed nut-driven ring body (111) in order to form an interactive planetary gear set function.

The upper part of the planetary gear radial arm base (127) is installed with one or more jack posts (128) for the planetary gear (131) to effect rotary operation. Axial hole (126) is installed in planetary gear radial arm base (127) to allow the boss (125) at the lower end of the sun gear cylinder (121) to rotate in it. The lower side of the planetary gear radial arm base (127) is made into one piece or assembled to form a polyhedral prismatic structure (123) extending downwards in order to couple and move with the inner polygonal hole (141) on the top side of the stud (140) of the thread (142).

The aforementioned installation is comprised of at least one jack post (128) and planetary gear (131).

Sun gear cylinder (121): The sun gear cylinder is a cylindrical structure with its integrated top section or formed into cylindrical tooth tip (122) by assembly method. The top side of the cylindrical tooth tip (122) has inner polygonal hole (124) or the inner polygonal hole (124) is replaced with polyhedral cylinder (124') in order to accept rotary drive by the operating tool. The lower end of the sun gear cylinder (121) has a boss (125) to couple with the axial hole (126) of the planetary gear radial arm base (127) for rotation. Sun gear cylinder (121) can accept drive from a separated and randomly coupling operational tool; or the operational tool can form an assembly with the sun gear cylinder (121) or be integrated as one structure.

The above-mentioned nut-driven ring body (111), sun gear cylinder (121), planetary gear (131) and the tools for driving the sun gear cylinder (121) collectively form the sun gear-driven magnification driving tool.

Figure 9:
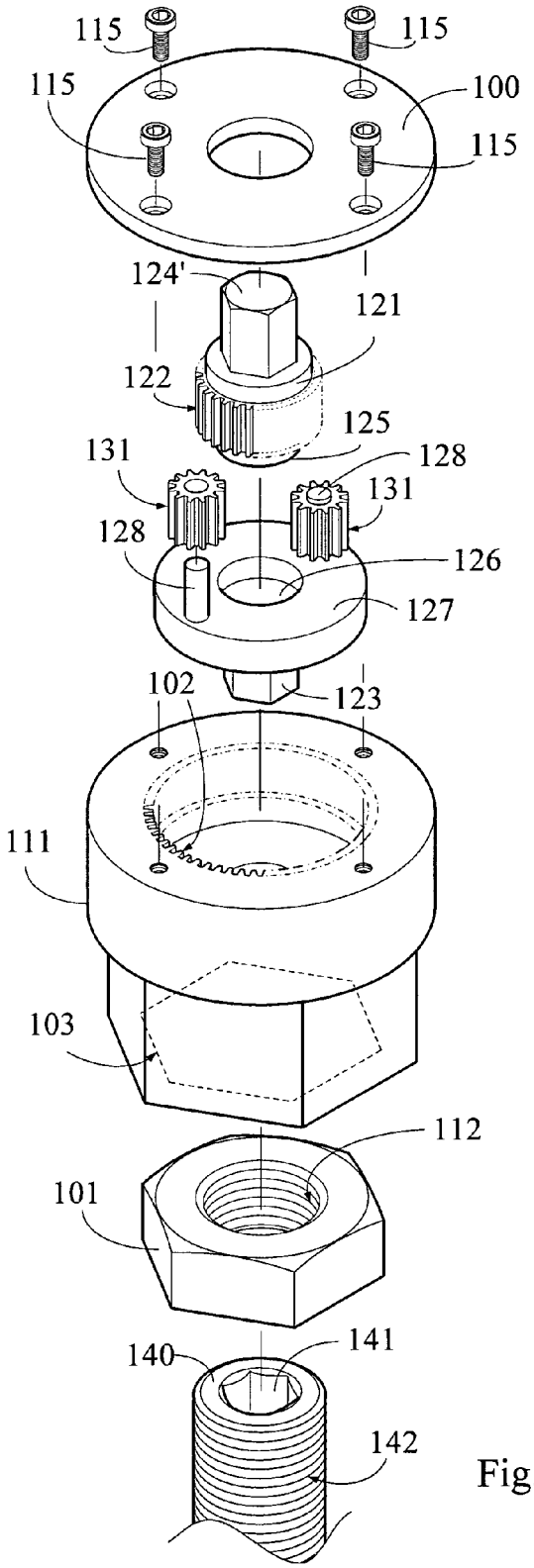
FIG. 9 is a dimensional view of the inner polygonal hole (124) replacing the polyhedral cylinder (124') in FIG. 1 to FIG. 4
Figure 10:
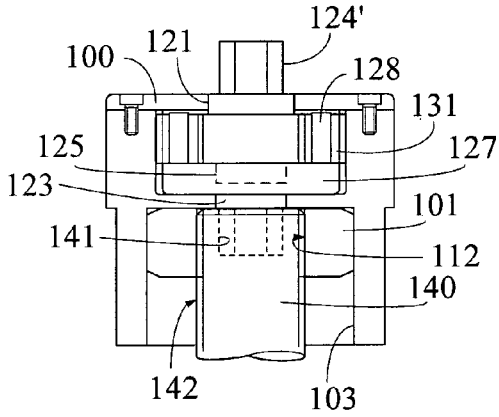
FIG. 10 is the cross-sectional view of FIG. 9

The sun gear-driven magnification driving tool, wherein the inner polygonal hole (124) of the sun gear cylinder (121) is optionally replaced by the polyhedral cylinder (124') as shown in the dimensional view in FIG. 9 wherein the polyhedral cylinder (124') replaces the inner polygonal hole (124) in FIG. 1 to FIG. 4. When the polyhedral cylinder (124') is chosen to be installed, the formation will be as shown in the cross-sectional view of FIG. 10 regarding the installation of the polyhedral cylinder (124') in FIG. 9.

Figure 11:
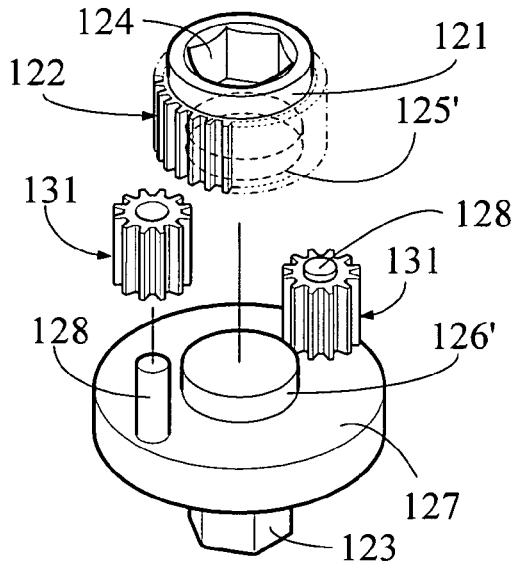
FIG. 11 is an operational view of the installation of an axial hole (125') on the sun gear cylinder (121) and the installation of an boss (126') on the planetary gear radial arm base (127)

The aforementioned sun gear-driven magnification driving tool, wherein boss (125) that is installed on the sun gear cylinder (121) and the axial hole (126) that is installed in the planetary gear radial arm base (127) are also in the form of a reversed structure as shown in FIG. 11; an inter-rotating couple with one as the axial hole (125'), and the other as a boss (126').

The aforementioned sun gear-driven magnification driving tool also makes or forms as an assembly the lower side of the aforementioned planetary gear radial arm base (127) into a sleeve with inner polygonal hole (123') (as shown in FIG. 5) to replace the polyhedral prismatic structure (123) in order to couple and move with the relatively made polyhedral cylinder (141') on top of the stud (140).

The aforementioned sun gear-driven magnification driving tool, wherein the operational tool is the optional screwdriver. The inner polygonal hole (141) of the stud (140) and/or the inner polygonal hole (124) of the sun gear cylinder (121) are converted into structures with slots to couple with the working end shape of the screw driver.

The present invention of a sun gear-driven magnification driving tool relies on manpower or fluid motor or mechanical power or electric motor to drive the operational tool for driving the sun gear cylinder (121); and to further drive the nut-driven ring body (111) with the inner ring gear (102). According to the speed reduction multiples of the planetary gear set, a magnification effect is produced to drive the nut (101) to screw on the thread (142) of the stud (140) in order to make locking or loosening drive.

Figure 12:
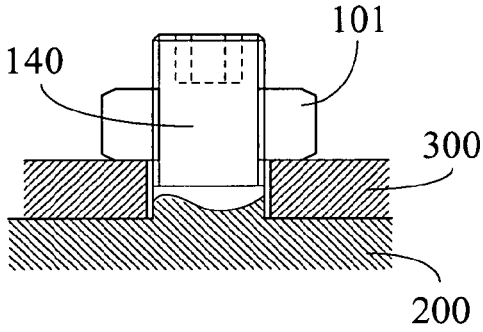
FIG. 12 is a functional view of the driven stud (140) being welded on the structure (200)
Figure 13:
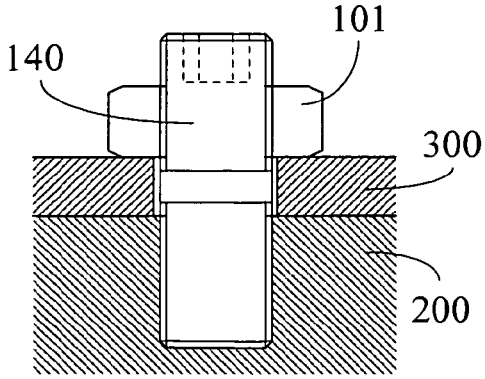
FIG. 13 is a functional view of the stud (140) being screwed on the screw hole of the structure (200) of the present invention
Figure 14:
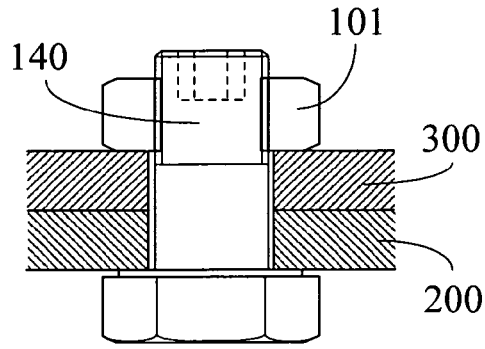
FIG. 14 is a functional view of the present invention showing the stud (140) penetrating the structure with the other end installed with a nut
Figure 15:
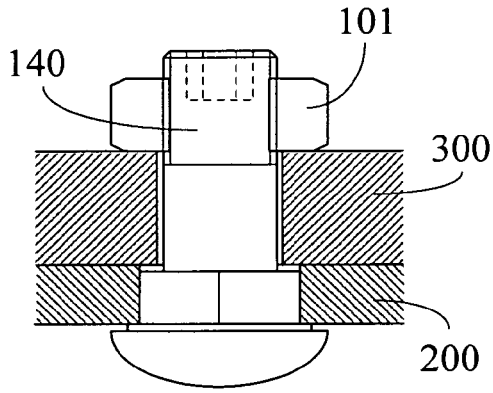
FIG. 15 is a functional view of the stud (140) of the present invention penetrating through the structure (200) with a limit stud bolt head at the other end
Figure 16:
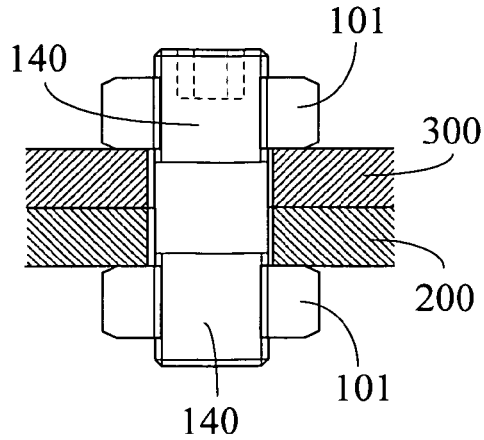
FIG. 16 is a functional view of the present invention showing both ends of the stud (140) installed with nuts (101)

Anti-vibration padding ring or gasket is optionally installed in the space between the drivable nut (101) and the stud (140) of the sun gear-driven magnification driving tool or the nut is directly screwed on the thread (142) of the stud (140). The bottom end of the stud (140) serves as:

1) The stud (140) is welded on the structure (200) and the nut (101) is screwed on the stud (140) to lock or release the fixed element (300), its characteristics is that the stud is facing towards the rear end of the tool, and it contains an inner polygonal hole or polyhedral; FIG. 12 is a functional view of the present invention showing the driven stud (140) being welded on the structure (200); or 2) The stud (140) is screwed into the screw hole of the structure (200) by means of the stud structure and the nut (101) is screwed on the stud (140) in order to lock or release the fixed element (300), its characteristics is that the stud is facing towards the rear end of the tool, and it contains an inner polygonal hole or polyhedral; FIG. 13 is a functional view of the present invention showing the stud (140) being screwed into the screw hole of the structure (200); or 3) The stud (140) penetrates through the structure (200) with a nut at the other end joined to the structure (200); the nut (101) serves to screw onto the stud (140) in order to lock or release the fixed element (300), its characteristics is that the stud is facing towards the rear end of the tool, and it contains an inner polygonal hole or polyhedral; FIG. 14 is a functional view of the present invention showing the stud (140) penetrating the structure with the other end installed with a nut; or 4) The stud (140) penetrates through the structure (200) with a limit stud bolt head at the other end joined to the structure (200); the nut (101) serves to screw on the stud (140) in order to lock or release the fixed element (300), its characteristics is that the stud is facing towards the rear end of the tool, and it contains an inner polygonal hole or polyhedral; FIG. 15 is a functional view of the present invention showing the stud (140) penetrating through the structure (200) with a limit stud bolt head at the other end; or 5) The stud (140) penetrates through the structure (200) and the fixed element (300), and nuts (101) are screwed on both ends of the stud (140) in order to lock or release the fixed element (300), its characteristics is that the stud is facing towards the rear end of the tool, and it contains an inner polygonal hole or polyhedral; FIG. 16 is the functional view of the present invention showing both ends of the stud (140) installed with nuts (101);

Drive operational tool employs one or more driving method of operational drive on the sun gear cylinder (121) and/or stud (140) including: 1) one directional or reverse rotary drive 2) reciprocating type one-way drive in which one driving direction produces driving effect while the other does not produce driving effect; 3) reciprocating type one-way drive in which one driving direction is chosen to produce driving effect while the other direction does not produce driving effect.

Aside from the sun gear cylinder (121) having protruding polyhedral cylinder (124') or inner polygonal hole (124); and/or the stud (140) head having inner protruding hole (141) or protruding polyheadral cylinder (141'), the kinds of sun gear-driven magnification driving tools are many. The following are merely some of the several modes which are not to be used as restrictions. Coupling modes are formed by one or more of the following:

1) The sun gear cylinder (121) can randomly couple with driving tools with T-type or L-type handles;

2) The sun gear cylinder (121) and the T-type or L-type handle driving tool assume an integrated structure or an assembled structure;

3) The randomly coupling driving tools of the sun gear cylinder (121), or the assembly type or integrated type driving tools including the T-type or L-type handles possess articulating structure with foldable or universal adjusting angles;

4) The sun gear cylinder (121) has concave inner polygonal hole (124) to accept drive modes of relatively coupleable driving tools including pulling by pulling tools or drive from rotary drive tools;

5) The sun gear cylinder (121) has protruding polyhedrons to accept driving modes of relatively coupling driving tools including drive by pulling tools or drive from rotary driving tools.

Aside from using various kinds of driving tools such as socket wrench, open wrench, closed wrench or polygonal wrench, the driving tool provided by the sun gear-driven magnification driving tools for driving the sun gear cylinder (121) and/or the stud (140) further include one or more of the following functional devices such as; 1) functional devices with torque limit; 2) functional devices which can adjust and set the required torque limit; 3) functional device with drive torque analog or digital display; 4) functional device that display drive torque with sound or voice; 5) functional device that displays drive torque with lamps.

The invention claimed is:

1. A sun gear driving tool for rotating an internally-threaded nut relative to an externally-threaded stud structure, said externally-threaded stud structure including an axially-extending polygonal inner blind hole, opening, or projection at a top end, comprising:

a cover arranged to be fixed to a nut driving ring body, said cover including a central opening for providing access to a sun gear cylinder, said sun gear cylinder being engageable through the central opening by an operating tool that rotates the sun gear cylinder relative to the cover and nut driving ring body, wherein said nut driving ring body includes a ring gear and a downwardly extending sleeve that fits over the nut to cause the nut to rotate with the nut driving body, wherein said sun gear cylinder includes or is integral with a sun gear and is rotatably mounted on a planetary gear radial arm base, wherein said planetary gear radial arm base has a polyhedral prismatic structure that engages said polygonal opening or polygonal projection at the top end of the stud structure to prevent relative rotation between the planetary gear radial arm base and the stud structure when the nut is driven by the nut driving ring body, wherein at least one planetary gear is rotatably mounted on the planetary gear radial arm base and engaged with the sun gear and the ring gear, and wherein rotation of said sun gear by said operating tool causes relative rotation of the ring gear through the planetary gear to drive the nut driving ring body and exert a magnified driving force on the nut.

2. A sun gear driven driving tool as claimed in claim 1, wherein said cover is arranged to be fixed to a top of said nut driving ring body by screws.

3. A sun gear driven driving tool as claimed in claim 1, wherein said planetary gear radial arm base includes a post for rotatably mounting said planetary gear.

4. A sun gear driven driving tool as claimed in claim 3, further comprising at least one additional said planetary gear and post.

5. A sun gear driven driving tool as claimed in claim 1, wherein said polyhedral prismatic structure is one of a polyhedral opening in said planetary gear radial arm base for engagement with said polygonal projection of the stud structure or a polyhedral extension of said planetary gear radial arm base for engagement with a polygonal opening in the stud structure.

6. A sun gear driven driving tool as claimed in claim 1, wherein said sun gear cylinder has a polygonal surface or a polygonal opening for coupling with the operating tool to rotate said planetary gear.

7. A sun gear driven driving tool as claimed in claim 1, wherein the operating tool is integral with the sun gear cylinder.

8. A sun gear driven driving tool as claimed in claim 1, wherein the operating tool is separate from the sun gear cylinder.

9. A sun gear driven driving tool as claimed in claim 1, wherein the sun gear cylinder is mounted to the planetary gear radial arm base by a lower boss that extends into an axial opening of the planetary gear radial arm, or by an opening that receives an upper boss of the planetary gear radial arm base.

10. A sun gear driven driving tool as claimed in claim 1, wherein the driving device is a screw driver and the planetary gear stud includes a slot for receiving the screw driver.

11. A sun gear driven driving tool as claimed in claim 1, wherein said driving device is driven manually, by a fluid motor, by mechanical power, or by electric power.

12. A sun gear driven driving tool as claimed in claim 1, wherein the stud structure extends from a structural element, and wherein a fixed element is sandwiched between the structural element and the nut, the nut being rotated by the driving device to lock or release the fixed element.

13. A sun gear driven driving tool as claimed in claim 12, wherein the stud structure is welded to the structural element.

14. A sun gear driven driving tool as claimed in claim 1, wherein the stud structure faces a rear end of the tool and contains an inner polygonal hole or polyhedral surface for engagement with said polyhedral surface or polygonal hole of said sun gear cylinder.

15. A sun gear driven driving tool as claimed in claim 1, wherein a bottom end of the stud structure is screwed into a screw hole of a structural element and the nut is screwed on the stud structure in order to lock or release the fixed element positioned between the nut and the structural element.

16. A sun gear driven driving tool as claimed in claim 1, wherein a bottom end of the stud structure penetrates through a structural element, said nut being threaded onto the stud structure to lock or release the fixed element.

17. A sun gear driven driving tool as claimed in claim 1, wherein the bottom end of the stud structure includes a polygonal bold head, a polygonal surface and curved bolt head, or a threaded section arranged to be threaded into a second nut.

* * * * *